United States Patent [19]

Potratz

[11] Patent Number: 4,960,398

[45] Date of Patent: Oct. 2, 1990

[54] STERN DRIVE MARINE PROPULSION SYSTEM WITH AUTOMATIC TRIM CONTROL AND EXHAUST CONTROL

[75] Inventor: Douglas R. Potratz, Oshkosh, Wis.

[73] Assignee: Brunswick Corporation, Skokie, Ill.

[21] Appl. No.: 291,145

[22] Filed: Dec. 28, 1988

[51] Int. Cl.[5] ..... B63H 21/32

[52] U.S. Cl. ..... 440/53; 440/89

[58] Field of Search ..... 440/1, 2, 53, 61, 88, 440/89; 60/324, 288

[56] References Cited

U.S. PATENT DOCUMENTS 4,318,699 3/1982 Wenstadt et al. ..... 440/53

4,600,395 7/1986 Pichl ..... 440/89

4,773,215 9/1988 Winberg et al. ..... 440/89

*Primary Examiner*—Joseph F. Peters, Jr.

*Assistant Examiner*—Edwin L. Swinehart

*Attorney, Agent, or Firm*—Andrus, Sceales, Starke & Sawall

[57] ABSTRACT

A stern drive marine propulsion system, including an exhaust discharge control mechanism for selectively routing exhaust to an above-water outlet and to a below-water outlet, and an automatic trim control mechanism, is provided with circuitry interconnecting such components. The trim control system and the exhaust control system are selectively interconnectable so that the exhaust control is actuated responsive to operation of the trim control system.

10 Claims, 1 Drawing Sheet

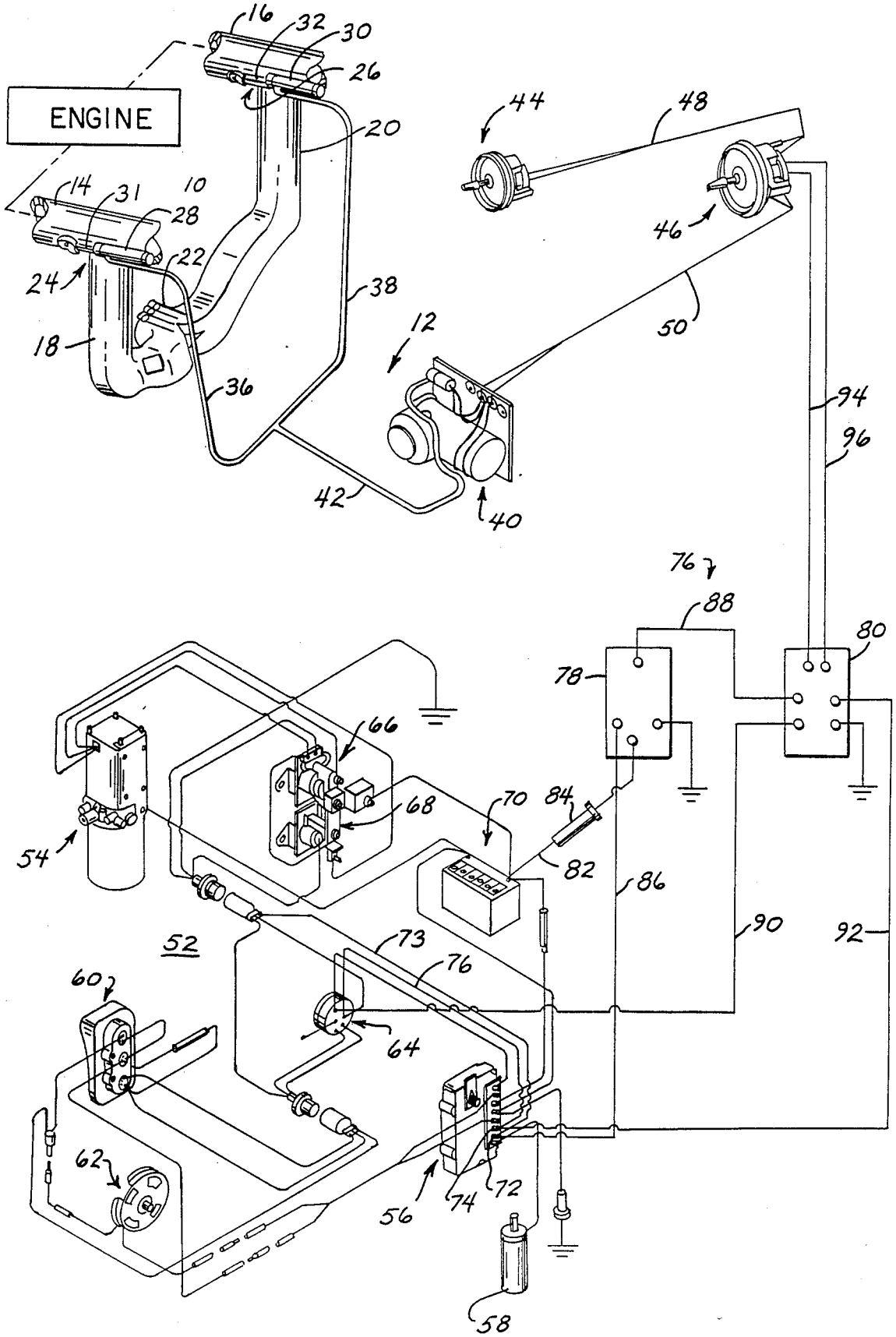
ENGINE
16
32
30
26
20
44
48
14
31
10
28
22
24
46
38
18
12
50
36
94
96
42
40
76
88
80
78
66
68
70
84
54
82
86
52
73
76
90
92
60
64
62
56
74
72
58

STERN DRIVE MARINE PROPULSION SYSTEM WITH AUTOMATIC TRIM CONTROL AND EXHAUST CONTROL

BACKGROUND OF THE INVENTION

This invention relates to a marine propulsion system, and more particularly to a trimmable stern drive system.

In a stern drive marine propulsion system, it has been found advantageous to employ a system for automatically adjusting the trim position of the stern drive unit in response to one or more preselected operating conditions, such as engine speed or boat attitude. Such a system automatically increases boat speed during high speed operation by adjusting the trim angle so as to reduce boat drag, and eliminates the need for the boat operator to manually adjust trim position. Additionally, it has been found that an increase in engine power output can be achieved by routing engine exhaust through the boat transom to an above-water exhaust outlet, as opposed to routing the exhaust through the drive unit and discharging through a below-water exhaust outlet, such as through the propeller hub. However, discharge of exhaust through an above-water outlet results in an increase in the level of noise produced during boat operation.

The object of the present invention is to combine the increase in boat speed resulting from employment of an automatic trimming system, with the increase in power which can be achieved by selectively routing exhaust to an above-water discharge instead of to a below-water discharge. In accordance with the invention, a marine propulsion system includes an engine interconnected with an exhaust discharge system, which includes an above-water exhaust discharge outlet and a below-water exhaust discharge outlet. Exhaust control means is provided for controlling discharge of exhaust through the above-water outlet and through the below-water outlet. A trimmable drive unit is drivingly interconnected with the engine, and trimming means is provided for trimming the drive unit. The invention discloses means interconnecting the exhaust control means and the trimming means so that the exhaust control means is responsive to actuation of the trimming means. In a preferred embodiment, the trimming means is operable in response to one or more preselected boat operating conditions, such as engine speed or boat attitude. That is, for example, when engine speed reaches a certain predetermined level, the trim position of the drive unit is automatically adjusted so as to provide an increase in boat speed by reducing drag. When engine speed falls below the predetermined level, the trimming means trims the drive unit in. The automatic trimming means preferably includes control means for outputting a signal for controlling the trim position of the drive unit, and the means interconnecting the trimming means and the exhaust control means is preferably responsive to the output signal provided by the control means.

BRIEF DESCRIPTION OF THE DRAWINGS

The drawing illustrate the best mode presently contemplated of carrying out the invention.

The drawing FIGURE is a schematic representation of an automatic trim control system interconnected with an exhaust control system.

DETAILED DESCRIPTION OF THE PREFERRED EMBODIMENT

With reference to the drawing FIGURE, an exhaust discharge system is illustrated at 10, and an exhaust control system is illustrated at 12. Exhaust discharge system 10 includes a pair of exhaust pipes 14, 16 which are interconnected with exhaust elbows provided on an inboard mounted engine for receiving exhaust therefrom. Exhaust pipes 14, 16 are substantially horizontal pipes which extend aft through the transom to provide an above-water exhaust discharge outlet. Exhaust pipes 14, 16 are interconnected with a pair of downwardly extending pipes 18, 20, respectively, each of which opens into the exhaust passage provided within pipes 14, 16. Downwardly extending pipes 18, 20 merge into a single pipe 22 at their lower ends. Pipe 22 is interconnected with an exhaust discharge system provided in the stern drive unit for providing ultimate below-water discharge of exhaust routed therethrough. In a typical exhaust system, exhaust is discharged through the propeller hub.

Exhaust control system 12 controls the discharge of exhaust through exhaust discharge system 10 by determining whether exhaust is routed through the above-water exhaust discharge outlets provided in exhaust pipes 14, 16, or is routed downwardly through exhaust pipes 18, 20 for ultimate below-water discharge through pipe 22. Exhaust control system 12 is described in detail in U.S. Pat. No. 4,773,215 to Winberg et al, which is hereby incorporated by reference. Exhaust control system 12 includes a pair of pneumatic actuators 24, 26 mounted to exhaust pipes 14, 16, respectively, each of which includes an air cylinder 28, 30, respectively. Cylinders 28, 30 are provided with extendable and retractable pistons 31, 32, which are interconnected with butterfly valves disposed at the juncture between exhaust pipes 14, 16 and downwardly extending pipes 18, 20, respectively. Air cylinders 28, 30 are selectively provided with pressurized air throuqh air lines 36, 38, respectively, which are interconnected with an air pump 40 by means of a line 42.

A manual switch 44 is provided for selectively actuating air pump 40 so as to selectively provide air pressure to cylinders 28, 30, thereby manually controlling discharge of exhaust downwardly through pipes 18, 20 to the below-water discharge associated therewith, or aft through pipes 14, 16 to an above-water discharge. Manual switch 44 is interconnected with an automatic exhaust control switch 46, as will be explained hereinafter. When automatic exhaust control switch 46 is in the "off" position, automatic switch 46 simply acts as a conduit interconnecting switch 44 with pump 40 through conductors 48, 50.

An automatic trim control system is illustrated schematically at 52. An automatic trim control system of the type employed herein is disclosed in Wenstadt et al U.S. Pat. No. 4,318,699, hereby incorporated by reference. Automatic trim control system 52 includes a trim pump 54 which is interconnected with a trim cylinder (not shown) for selectively extending and retracting the trim cylinder, thereby controlling the trim position of the drive unit. An automatic trim control module 56 (Mercury Marine part No. 93732A7) is interconnected with a coil assembly, shown at 58, provided on the engine for supplying an input signal which varies according to engine speed. Automatic trim control system 52 further includes a manual trim control 60, a trim limit switch 62, a three-way automatic trim control switch 64, a "trim out" solenoid 66 and a "trim in" solenoid 68, and a battery 70.

When automatic trim control switch 64 is in the "manual" or "off" position, the trim position of the drive unit is controlled by operator actuation of manual trim control 60. When automatic trim control switch 64 is in the "automatic" or "on" position, manual control of trim position is overridden, and trim position is determined by control module 56.

As noted previously, control module 56 is interconnected with engine coil assembly 58, which provides a signal varying according to engine speed. When automatic trim control switch 64 is "on", and engine speed exceeds a certain predetermined level, an "out" signal is output by control module 56 at a terminal 72, which through a conductor 73 actuates solenoid 66 which, through trim pump 54, causes extension of the trim cylinder and trimming out of the drive unit. When engine speed falls below the predetermined level, an "in" signal is output by control module 56 at a terminal 74. Such signal is transmitted through a conductor 76 and automatic trim control switch 64 for ultimately actuating "in" solenoid 68, which causes trim pump 54 to suck fluid from the trim cylinder for retracting the trim cylinder and trimming the drive unit in.

As shown, battery 70 provides power to control module 56, trim pump 54 and "in" and "out" solenoids 66, 68.

Interconnecting circuitry, shown generally at 76, is provided for interconnecting automatic trim control system 52 with exhaust control system 12. As will be explained, interconnecting circuitry 76 provides actuation of exhaust control system 12 in response to adjustment of trim position through automatic trim control system 52. In this manner, when automatic trim control switch 64 is switched to its "on" position and the stern drive unit is trimmed out by output of an electrical signal from control module 56, such output simultaneously actuates exhaust control system 12 for routing exhaust through pipes 14, 16 for ultimate discharge through the above-water discharge associated with each such pipe. This provides a boost in horsepower by discharge of exhaust above water, while adjusting the stern drive trim angle so as to reduce boat drag and thereby increase engine speed. When the stern drive unit is trimmed in, the automatic exhaust control is deactivated so as to once again route exhaust downwardly through pipes 18, 20 for below-water discharge. This system provides quiet boat operation at low engine speeds, due to below-water discharge of exhaust.

Interconnecting circuitry 76 includes a first relay 78 and a second relay 80. Relays 78, 80 are as manufactured by Magnecraft Electric Company under its part no. W88CPX-6, or by Custom Connector Company under its part no. RB08-PC. Relays 78, 80 are both normally open. As shown, relay 78 is interconnected with battery 70 via a conductor 82 and a fuse 84. Relay 78 is also interconnected with terminal 72 on control module 56 via a conductor 86. Relay 80 is interconnected with relay 78 via a conductor 88, and with automatic trim control switch 64 via a conductor 90. A conductor 92 interconnects relay 80 with terminal 74 on control module 56, and a pair of conductors 94, 96 interconnect relay 80 with automatic exhaust control switch 46.

In operation, it is seen that power is constantly supplied to relay 78 through conductor 82. When a trim "out" signal is output from control module 56 through terminal 72, such signal is simultaneously transmitted through conductor 86 to relay 78. This closes relay 78, so that power is supplied through conductor 88 to relay 80, which then closes. Power is then supplied from battery 70 simultaneously to trim pump 54 and air pump 40, so that the stern drive unit is simultaneously trimmed out and pressurized air is supplied to pneumatic actuators 24, 26 for opening the butterfly valves associated therewith, resulting in above-water exhaust discharge.

When the output electrical signal at terminal 72 terminates due to engine speed falling below the predetermined level, relay 78 is then reopened, cutting off supply of power therethrough to air pump 40. Simultaneously, an output electrical signal is provided at terminal 74 and passes through conductor 92 to relay 80 to close relay 80. This closure of relay 80 provides sufficient power to air pump 40 through conductor 96, switch 46 and conductor 50, to actuate a bleeder valve associated with air pump 40, thereby allowing pressurized air to bleed off from pneumatic actuators 24, 26. This results in closure of the butterfly valves associated with actuators 24, 26, and below-water discharge of exhaust through pipes 18, 20, 22. The output signal at terminal 74 simultaneously actuates "in" solenoid 68, which actuates trim pump 54 to retract the trim cylinder. In this manner, while automatic trim control system 52 retracts the trim cylinder through trim pump 54, below-water exhaust discharge is resumed.

The invention thus provides a system for selectively interconnecting the trim control system and exhaust control system of a stern drive, for easing operation of such a system and providing increased power availability and boat speed.

Various alternatives and modifications are contemplated as being within the scope of the following claims particularly pointing out and distinctly claiming the subject matter regarded as the invention.

I claim:

1. A marine propulsion system, comprising:

an engine;

an exhaust discharge system for discharging exhaust from said engine, said exhaust system including an above-water exhaust discharge outlet and a below-water exhaust discharge outlet;

exhaust control means for controlling discharge of exhaust through said above-water outlet and said below-water outlet;

a trimmable drive unit drivingly interconnected with said engine;

trimming means for trimming said drive unit; and means interconnecting said exhaust control means and said trimming means so that said exhaust control means is responsive to actuation of said trimming means.

2. The marine propulsion system of claim 1, wherein said trimming means comprises automatic trimming means for controlling the trim position of said drive unit in response to one or more preselected operating conditions of said marine propulsion system so that said drive unit is automatically trimmed out during high speed operation to increase boat speed by reducing drag, and is automatically trimmed in during low speed operation.

3. The marine propulsion system of claim 2, wherein said means interconnecting said exhaust control means and said trimming means actuates said exhaust control means so as to route exhaust through said above-water outlet when said drive unit is trimmed out so as to increase horsepower, and thereby boat speed, and further actuates said exhaust control means to route exhaust through said below-water outlet when said drive unit is trimmed in during low speed operation.

4. The marine propulsion system of claim 3, wherein said automatic trimming means includes a second control means interconnected with said trimmable drive unit, said second control means being responsive to said one or more operating conditions for outputting a signal to control the trim of said drive unit in response thereto, and wherein said means interconnecting said exhaust control means and said trimming means is responsive to the signal output from said second control means for controlling the discharge of exhaust through said above-water and below-water outlets.

5. The marine propulsion system of claim 4, wherein said second control means outputs an electrical signal to control the trim of said drive unit, and wherein said means interconnecting said exhaust control means and said trimming means is responsive to said output electrical signal for actuating said exhaust control means in response thereto.

6. The marine propulsion system of claim 5, wherein said exhaust control means comprises a pressurized air actuated valve, said valve being selectively positionable for controlling discharge of exhaust through said above-water outlet and said below-water outlet, and pressurized air supply means for selectively supplying pressurized air to said valve for controlling the position of said valve, and wherein said means interconnecting said exhaust control means and said automatic trimming means is interconnected with said pressurized air supply means so that said output electrical signal from said automatic trimming means selectively actuates said pressurized air supply means for controlling the position of said valve.

7. In a marine propulsion system including an engine; an exhaust discharge system for discharging exhaust from said engine, said exhaust discharge system including an above-water exhaust discharge outlet and a below-water exhaust discharge outlet; exhaust control means for controlling discharge of exhaust through said above-water outlet and said below-water outlet; a trimmable drive unit drivingly interconnected with said engine; and trimming means for trimming said drive unit, the improvement comprising means interconnecting said exhaust control means and said trimming means so that said exhaust control means is responsive to actuation of said trimming means.

8. A marine propulsion system, comprising:

an engine;

an exhaust discharge system for discharging exhaust from said engine, said exhaust discharge system including an above-water exhaust discharge outlet and a below-water exhaust discharge outlet;

exhaust control means for controlling discharge of exhaust through said above-water outlet and said below-water outlet, said exhaust control means comprising a selectively positionable pressurized air operated valve for controlling discharge of exhaust, and pressurized air supply means for selectively supplying pressurized air to said valve for controlling the position of said valve;

a trimmable drive unit drivingly interconnected with said engine;

automatic trimming means for controlling the trim position of said drive unit in response to one or more preselected operating conditions of said marine propulsion system, so that said drive unit is automatically trimmed out during high speed operation to increase boat speed by reducing drag, and is automatically trimmed in during lower speed operation, said automatic trimming means including control means responsive to said one or more operating conditions for outputting a first electrical signal to trim said drive unit out and a second electrical signal to trim said drive unit in; and means interconnecting said exhaust control means and said automatic trimming means so that said exhaust control means is responsive to actuation of said trimming means, said interconnecting means being responsive to said output electrical signal from said automatic trimming means for actuating said pressurized air supply means in response thereto, thereby controlling the position of said valve and the discharge of exhaust.

9. The marine propulsion system of claim 8, wherein said interconnecting means comprises a pair of normally open relays interposed between said automatic trimming means and said exhaust control means, with one of said relays being interconnected with said pressurized air supply means and being responsive to said second output electrical signal for trimming said drive unit in, and the other of said relays being interconnected with electrical power supply means and said first-mentioned relay, and being responsive to said first output electrical signal for trimming said drive unit out.

10. A method of adjusting the power output of a marine propulsion system including an engine; an exhaust discharge system for discharging exhaust from said engine, said exhaust system including an above-water exhaust discharge outlet and a below-water exhaust discharge outlet; and a trimmable drive unit drivingly interconnected with said engine, comprising the steps of:

providing an exhaust control means for controlling discharge of exhaust through said above-water outlet and said below-water outlet;

providing an automatic trimming means for trimming said trimmable drive unit in response to one or more preselected operating conditions of said marine propulsion system; and interconnecting said exhaust control means with said automatic trimming means so that said exhaust control means is responsive to actuation of said automatic trimming means.

* * * * *